US009410269B2

(12) United States Patent
Stündl et al.

(10) Patent No.: US 9,410,269 B2
(45) Date of Patent: Aug. 9, 2016

(54) METHOD AND DEVICE FOR CRIMPING A MULTIFILAMENT THREAD

(71) Applicant: Oerlikon Textile GMBH & Co. KG, Remscheid (DE)

(72) Inventors: Mathias Stündl, Wedel (DE); Claus Matthies, Ehndorf (DE); Christian Hubert, Neumünster (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 240 days.

(21) Appl. No.: 14/324,655

(22) Filed: Jul. 7, 2014

(65) Prior Publication Data

US 2014/0317895 A1 Oct. 30, 2014

Related U.S. Application Data

(63) Continuation-in-part of application No. PCT/EP2013/050050, filed on Jan. 3, 2013.

(30) Foreign Application Priority Data

Jan. 7, 2012 (DE) ..... 10 2012 000 166

(51) Int. Cl.
*D02G 1/12* (2006.01)

(52) U.S. Cl.
CPC ..... *D02G 1/122* (2013.01); *D02G 1/12* (2013.01); *D02G 1/125* (2013.01)

(58) Field of Classification Search
CPC ..... D02G 1/12; D02G 1/122; D02G 1/125; D02G 1/127; D02J 1/04
USPC ..... 28/263, 265, 267, 268
See application file for complete search history.

(56) References Cited

U.S. PATENT DOCUMENTS 3,777,338 A * 12/1973 Vermeer ..... D02G 1/125 28/250
3,802,038 A * 4/1974 Bauch ..... D02G 1/125 28/248

(Continued)

FOREIGN PATENT DOCUMENTS

CN 1693558 11/2005
CN 1732297 2/2006

(Continued)

OTHER PUBLICATIONS

English language machine translation of JP H05 287631, Nov. 2, 1993, 13 pages.*

(Continued)

*Primary Examiner* — Amy Vanatta
(74) *Attorney, Agent, or Firm* — Brinks Gilson & Lione; G. Peter Nichols

(57) ABSTRACT

A method and a device for crimping a multifilament thread are described. The thread is blown by means of a transport nozzle through a compressed air stream guided in a thread channel into a gas-permeable compression chamber. Inside the compression chamber, the thread is compressed to form a thread plug, which is then continuously removed through an outlet of the compression chamber. The compression and the removal of the thread plug are monitored by measuring the pressure of the compressed air stream. According to the invention, a plurality of pressures of the compressed air stream in the compression chamber are measured at a plurality of measurement points distributed over the length of the compression chamber for monitoring the thread plug formation in order to perform the compressing and cooling of the thread plug with a uniform filling of the compression chamber.

15 Claims, 3 Drawing Sheets

(56) References Cited

U.S. PATENT DOCUMENTS

| | | | | | |
|---|---|---|---|---|---|
| 3,863,311 | A * | 2/1975 | Cartlidge | B27M 3/002 | 242/413.1 |
| 3,911,539 | A * | 10/1975 | Hughes | D02G 1/12 | 19/0.46 |
| 4,956,901 | A * | 9/1990 | Koskol | B65D 85/04 | 28/250 |
| 5,351,374 | A | 10/1994 | Nabulon | | |
| 5,727,293 | A | 3/1998 | Weder | | |
| 7,155,787 | B2 | 1/2007 | Stündl | | |
| 8,342,834 | B2 | 1/2013 | Stündl | | |
| 2013/0174531 | A1 | 7/2013 | Stuendl | | |
| 2014/0053381 | A1 * | 2/2014 | Boetsch | D02G 1/125 | 28/249 |

FOREIGN PATENT DOCUMENTS

| | | |
|---|---|---|
| EP | 0 554 642 | 8/1993 |
| JP | H05 287631 | 11/1993 |

OTHER PUBLICATIONS

First Office Action dated Sep. 14, 2015 out of corresponding Chinese Patent Application No. 201380004867 (29 pages including English translation).

PCT/EP2013/050050 International Search Report dated Sep. 18, 2013 (4 pages including English translation).

PCT/EP2013/050050 International Preliminary Examination Report dated Jul. 8, 2014 (6 pages including English translation).

* cited by examiner

METHOD AND DEVICE FOR CRIMPING A MULTIFILAMENT THREAD

This application is a continuation-in-part of and claims the benefit of priority from PCT application PCT/EP2013/050050 filed Jan. 3, 2013; and German Patent Application No. 10 2012 000 166.5 filed Jan. 7, 2012; the disclosure of each is hereby incorporated by reference in its entirety.

BACKGROUND

The invention relates to a method for crimping a multifilament thread as well as to a device for crimping a multifilament thread.

When melt spinning synthetic multifilament threads, it is a common practice that prior to the winding process a crimp of the filament strands is impressed on the threads. Preferably, such crimps of the filament threads are produced according to the compression chamber concept. By means of a transport nozzle, the multifilament thread is pneumatically guided and blown into a compression chamber. For this purpose, the transport nozzle comprises a thread channel which is connected with a compressed air source to produce a compressed air stream. The thread is then guided via the compressed air stream into a compression chamber in which the thread is compressed to a thread plug. In the process, the filament strands of the thread are deposited in loops and bows on the surface of the thread plug and are compressed by means of the compressed air stream. Thereafter, the thread plug is uncoiled outside the compression chamber to form a crimped thread. For example, such a method and a device are known from EP 0 554 642.

In the known method and device, the formation of the thread plug is monitored, on the one hand, to avoid blowing the thread plug out of the compression chamber and, on the other hand, to avoid plugging the compression chamber. For monitoring purposes, the pressure of the compressed air stream is measured at the outlet of the transport nozzle. To keep the conditions during forming the thread plug as constant as possible, the actual value of the pressure measurement is compared with a target value or a set-point range. In the event that a permissible deviation between the actual value and the target value is determined, regulation of the thread plug speed is performed which is determined via a needle roll on the outlet side of the compression chamber.

Therefore, the known method and device provide the possibility to maintain predetermined target values of a pressure of the compressed air stream. However, it is not possible to measure a filling level of the compression chamber or a position of the thread plug, which could result in undesired effects, for example, that the thread plug is blown out. Furthermore, when product changes are made, adjustments of the compressed air stream are required depending on the respective titer of the thread, which inevitably change the target values and result in new reference values of the pressure of the compressed air stream.

In the known method and device, efforts have been made to measure the position of the thread plug by means of optical sensors to prevent such disadvantages. However, such optical measurement systems have only a limited field of application because high temperatures and a plurality of air-borne particles, such as preparation residues and dye particles, result in quick contamination of the crimping environment. Experience has shown that optical systems are completely unsuited for reliable operation in the environment of a compression chamber.

SUMMARY

Therefore, it is the object of the invention to further develop a method and a device for crimping a multifilament thread in such a way that it is possible to effectively monitor the crimping process while taking into consideration the actual plug position of the thread plug within the compression chamber.

Furthermore, it is the object of the invention to improve the generic method and device for crimping a multifilament thread in such a way that in case of a product change an automatic product optimization can take place.

The present invention is based on the knowledge that, depending on the position of the thread plug, the compressed air stream flowing into the compression chamber results in different pressure overloads inside the compression chamber. For example, it was discovered that, despite the fact that the compression chamber had gas-permeable walls, different pressure conditions developed in the compression chamber depending on the position of the thread plug. The present invention uses this knowledge so that multiple pressures of the compressed air stream inside the compression chamber are measured at different measurement points distributed over the length of the compression chamber. As a result, it is possible to derive the size of the filling level of the compression chamber merely from the ratio of the pressures to each other.

To this end, a monitoring system of the present invention has a plurality of pressure sensors for measuring multiple pressures of the compressed air stream inside the compression chamber. These pressure sensors are arranged at several measurement points, which are distributed over the length of the compression chamber. As a result, it is possible to simultaneously measure multiple pressures of the compressed air stream inside the compression chamber to achieve an optimum process adjustment by means of the evaluation.

In one embodiment, to obtain control over the thread plug formation with only a few measurement points and pressure measurements, at least one intake pressure of the compressed air stream in the inlet area of the compression chamber and an impact pressure of the compressed air stream in the storage area of the compression chamber is measured. As a result, it is possible from only two pressure measurements performed at different measurement points to determine the filling level of the compression chamber and the respective position of the thread plug merely from the ratio of the pressures to each other.

To optimize the process, in one embodiment, the compression and/or removal of the thread plug is controlled or regulated depending on a ratio between at least two pressures of the compressed air stream by changing at least one adjustment parameter. The ratio between the measured pressures shows whether the crimping is performed or changed with the selected adjustment parameters.

During the measurement of the intake pressure and the impact pressure inside the compression chamber it became evident that the ratio between the intake pressure determined over a measurement period and the impact pressure determined over that same measurement period should have a specific numerical value to achieve high quality and uniformity during the crimping process. Preferably, in one embodiment, the ratio is formed between the intake pressure determined over a measurement period and the impact pressure determined over that same measurement period, and is such that the adjustment parameter is not changed when the numerical value of the ratio ranges between 0.75 and 1.15. As long as the pressures in the inlet area and in the compression area have such a ratio, the operational setting is advantageous for crimping.

By way of contrast, when the ratio between intake pressure and compression pressure has a numerical value <0.75, the adjustment parameter is adjusted in such a way that a plug speed at the thread plug is reduced. In this case, the impact pressure is considerably higher than the intake pressure in the compression chamber, indicating an inadequate filling level of the compression chamber. In this respect, a reduced plug speed of the thread plug increases again the filling level of the compression chamber, resulting in an optimal range.

By way of contrast, a ratio between intake pressure and compression pressure having a numerical value >1.15 indicates that the filling level inside the compression chamber is too large so that the position of the thread plug approaches the inlet area of the compression chamber. In this case, the adjustment parameter is changed to the extent that the plug speed of the thread plug increases. As a result, obstructions of the compression chamber are completely avoided.

The method according to the present invention is independent of the adjusted static pressure of the compressed air stream, which can have different values depending on the product and titer of the thread. The parameters necessary for monitoring the crimping process can be derived merely from the ratio of the pressures of the compressed air stream inside the compression chamber.

Preferably, in one embodiment, the device according to the present invention can provide one of the pressure sensors located at an inlet area of the compression chamber and at least an additional pressure sensor located at a compression area of the pressure chamber. As a result, it is possible to measure two pressures of the compressed air stream changed in different ways by the filling level of the compression chamber.

In addition, it is possible in an advantageous manner to attach a further pressure sensor to an outlet area of the compression chamber. Here, the ratio between a discharge pressure and an impact pressure can indicate that the filling level of the compression is too low.

To be able to analyze directly and quickly the measurements measured by the pressure sensors, the monitoring system comprises evaluation electronics which are connected with the pressure sensors. Digital and analogous technologies make it possible to obtain respective measurement value evaluations.

In one embodiment, to allow for immediate reaction when monitoring the thread plug formation a transducer is attached to the evaluation electronics. Said transducer generates a control signal depending on the ratio between multiple pressures of the compressed air stream. As a result, the ratio generated from the average values of the pressure measurement can be immediately used to trigger a control algorithm.

According to an advantageous further development, the monitoring system is connected with a control device which acts on one or several control means for compressing and removing the thread plug. It is possible to integrate the monitoring device in a control circuit to crimp a highly uniform multifilament thread.

To influence the filling level and thus the position of the thread plug inside the compression chamber, the control means is preferably formed by a driven feed roller pair at the plug outlet of the compression chamber so that the removal of the thread plug is determined by the speed of the feed rollers.

In principle, the movement of the thread plug inside the compression chamber is also determined by friction which develops between the thread plug and the walls of the compression chamber. Advantageously, the friction can be influenced when the control means is formed by a suction device at the outer circumference of the compression chamber by means of which the compressed air is extracted. In addition, it is possible to decrease or increase the transport proportion of the compressed air stream by controlling the extraction of compressed air.

There are systems in which after texturing the thread plug is deposited directly on the cooling drum. Therefore, such cooling drums can also be used as a control means to transport the thread plug guided at the circumference of the cooling drum with modified circumferential speed to increase or reduce the plug speed.

Therefore, the device of the present invention is especially suitable for providing multifilament threads with high-quality, uniform crimping. Because of the high flexibility of the monitoring system, multifilament threads can be textured with a total titer of between 300 denier and 12,000 denier. In this way, it is possible to crimp in an advantageous manner textile threads, carpet yarns and even technical yarns.

The method of the present invention is explained in more detail by means of several embodiments of the device with reference to the enclosed figures.

DETAILED DESCRIPTION

Figure 1:
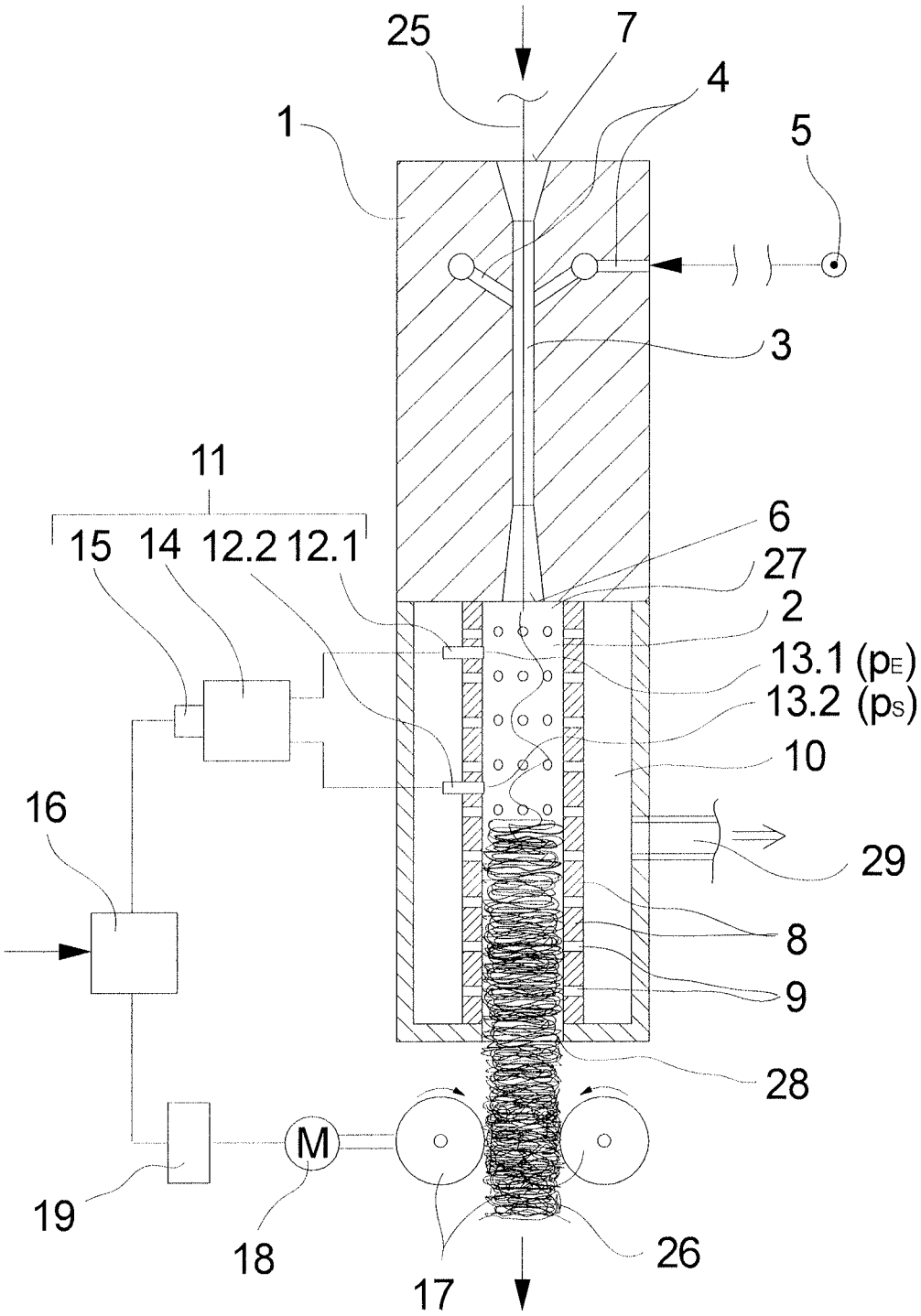
FIG. 1 is a schematic cross-sectional view of a first embodiment of the device according to the present invention.

FIG. 1 shows a cross-sectional view of a first embodiment of the device according to the present invention. The device has a transport nozzle 1 which contains a vertically extending thread channel 3. The thread channel 3 extends from a thread inlet 7 at the upper side of the transport nozzle 1 to a thread outlet 6 at the lower side of the transport nozzle 1. Several compressed air channels 4 open into the thread channel in the upper area of the transport nozzle 1, thus connecting the thread channel with a compressed air source 5. Further means (not shown) for guiding and processing the compressed air are provided between the transport nozzle 1 and the compressed air source 5. For example, it is customary to heat the compressed air before it enters the thread channel 3.

A compression chamber 2 is directly connected to the lower side of the transport nozzle 1. The compression chamber 2 is restricted by gas-permeable chamber walls 8 and kept inside a suction chamber 10. In this embodiment, the chamber walls 8 comprise a plurality of openings 9 which connect the inside space of the compression chamber 2 with the external suction chamber 10. By means of a suction nozzle 29, the suction chamber 10 is connected with a suction device (not shown).

The compression chamber 2 has a compression chamber inlet 27 which is directly connected with the thread outlet 6 of the transport nozzle 1. The compression chamber 2 extends from the compression chamber inlet 27 to a compression chamber outlet 28.

Below the compression chamber 2, a feed roller pair 17 is arranged which forms a transport gap for transporting a thread plug 26. The feed roller pair 17 is activated by means of a roller drive 18 which is connected with a control device 19.

A monitoring system 11 is provided for monitoring the plug formation of a thread plug inside the compression chamber 2. In one embodiment, the monitoring system 11 includes two pressure sensors 12.1 and 12.2, which are arranged at two measurement points 13.1 and 13.2 distributed over the length of the compression chamber 2. The measurement point 13.1 with the pressure sensor 12.1 is arranged in an inlet area of the compression chamber 2 directly below the compression chamber inlet 27. The measurement point 13.2 with the pressure sensor 12.2 is located in the middle region of the compression chamber, which is described here as the compression area of the compression chamber 2.

The pressure sensors 12.1 and 12.2 are connected with evaluation electronics 14 which interact with a transducer 15 for generating a control signal. The transducer 15 is connected with a controller 16. In this case, the controller 16 is directly connected with the control device 19 of the roller drive 18.

During operational processes, a compressed air stream is generated inside the thread channel 3 of the transport nozzle 1 by means of the compressed air source 5. The compressed air stream transports a thread 25 into the compression chamber 2 which has been sucked in via the thread inlet 7. In the process, the compressed air stream is blown into the compression chamber 2 via the thread outlet 6. At the beginning of the process, the compression chamber outlet 28 is briefly closed for the purpose of crimping the thread so that a thread plug 26 can accumulate inside the compression chamber 2. As soon as a thread plug 26 begins to form, the compression chamber outlet 28 is opened and the thread plug 26 is removed and transported via the feed roller pair 117. During the thread plug 26 formation, the individual filament strands forming the multifilament thread 25 are deposited in loops and bows on the surface of the thread plug 26 and compressed by means of the compressed air stream. To achieve uniform crimping of the filament strands, the position of the thread plugs inside the compression chamber 2, which determines the filling level of the compression chamber 2, has to be continuously maintained. It is especially important to ensure that the filling level of the compression chamber 2 is not too high, which could result in an obstruction of the thread outlet 6 of the transport nozzle 1. On the other hand, it is important to avoid that the compressed air stream on the surface does not blow the thread plug out of the compression chamber 2.

Via the pressure sensor 12.1 of the monitoring device 11, an intake pressure $p_E$ is measured in the inlet area of the compression chamber 2 for monitoring purposes. At the same time, impact pressure $p_S$ is measured with the second pressure sensor 12.2 at the second measurement point 13.2. The pressure sensors 12.1 and 12.2 directly supply the measured pressure values at the measurement points 13.1 and 13.2 to the evaluation electronics 14. Inside the evaluation electronics 14, the generated signals of the pressure sensors 12.1 and 12.2 are averaged by means of a measurement period to obtain an average value of the intake pressure $p_E$ and an average value of the impact pressure $p_S$, respectively. The average values for the intake pressure $p_E$ and the impact pressure $p_S$ are compared or set in proportion to each other. When both pressures have almost the same pressure level, a reliable filling level of the compression chamber 2 has been reached and no further changes are required. In this case: approximately $p_E=p_S$.

It has been found and demonstrated that a ratio between the intake pressure $p_E$ and the impact pressure $p_S$ with the numerical value $p_E/p_S=0.75$ to 1.15 characterizes a filling level of the compression chamber 2 that is advantageous for the crimping process. As long as the intake pressure $p_E$ and the impact pressure $p_S$ remain in this range no further changes of the adjustment parameters are required.

In the event that the ratio between the intake pressure $p_E$ and the impact pressure $p_S$ falls below the numerical value of $p_E/p_S<0.75$, a condition arises in which the impact pressure $p_S$ has a higher pressure level than the intake pressure $p_E$. This indicates that the compressed air stream basically passes the inlet area of the compression chamber 2 as an open jet without being transported via the openings 9 of the walls 8. This indicates that the compression chamber 2 has a low filling level so that the thread plug 26 must be positioned in the lower range of the compression chamber 2.

In this case, a control signal for changing the adjustment parameters is generated via the transducer 15. In this case, the adjustment parameter is a control frequency which is directly supplied via the controller 16 to the control device 19 of the roller drive 18. At the roller drive 18, the control frequency causes the conveying speed of the feed roller pair 17 to be reduced, thus decreasing the plug speed of the thread plug.

As a result, the position of the thread plug inside the compression chamber 2 is raised and the filling level of the compression chamber 2 increases.

In the event that the pressure level of the intake pressure $p_E$ is too high in comparison to the pressure level of the impact pressure $p_S$, the control level of the compression chamber 2 is too high, so that the position of the thread plug 26 inside the compression chamber 2 approaches compression chamber inlet 27. In this case, the ratio between the intake pressure $p_E$ and the impact pressure $p_S$ results in a numerical value of $p_E/p_S>1.15$. Via the transducer 15 a control signal is now generated which is supplied via the controller to the control device 19 to increase the transport speed of the feed roller pair 17. As a result, the plug speed of the thread plug 26 is increased, thus respectively reducing the filling level of the compression chamber.

During the process, the pressure measurements at the measurement points 13.1 and 13.2 are repeated continuously and in regular intervals to regulate the compression and transport of the thread plug inside the compression chamber 2.

Therefore, according to the embodiment shown in FIG. 1, the method and device of the present invention are suitable for performing uniform and consistent crimping of a multifilament thread by means of a feed roller pair 17 acting as control means. Advantageously, it is possible to compensate for the occurring process fluctuations and pressure fluctuations of the compressed air stream. The compression and deposit of the filament strands and the transport of the thread plug basically take place at a consistent filling level of the compression chamber.

Figure 2:
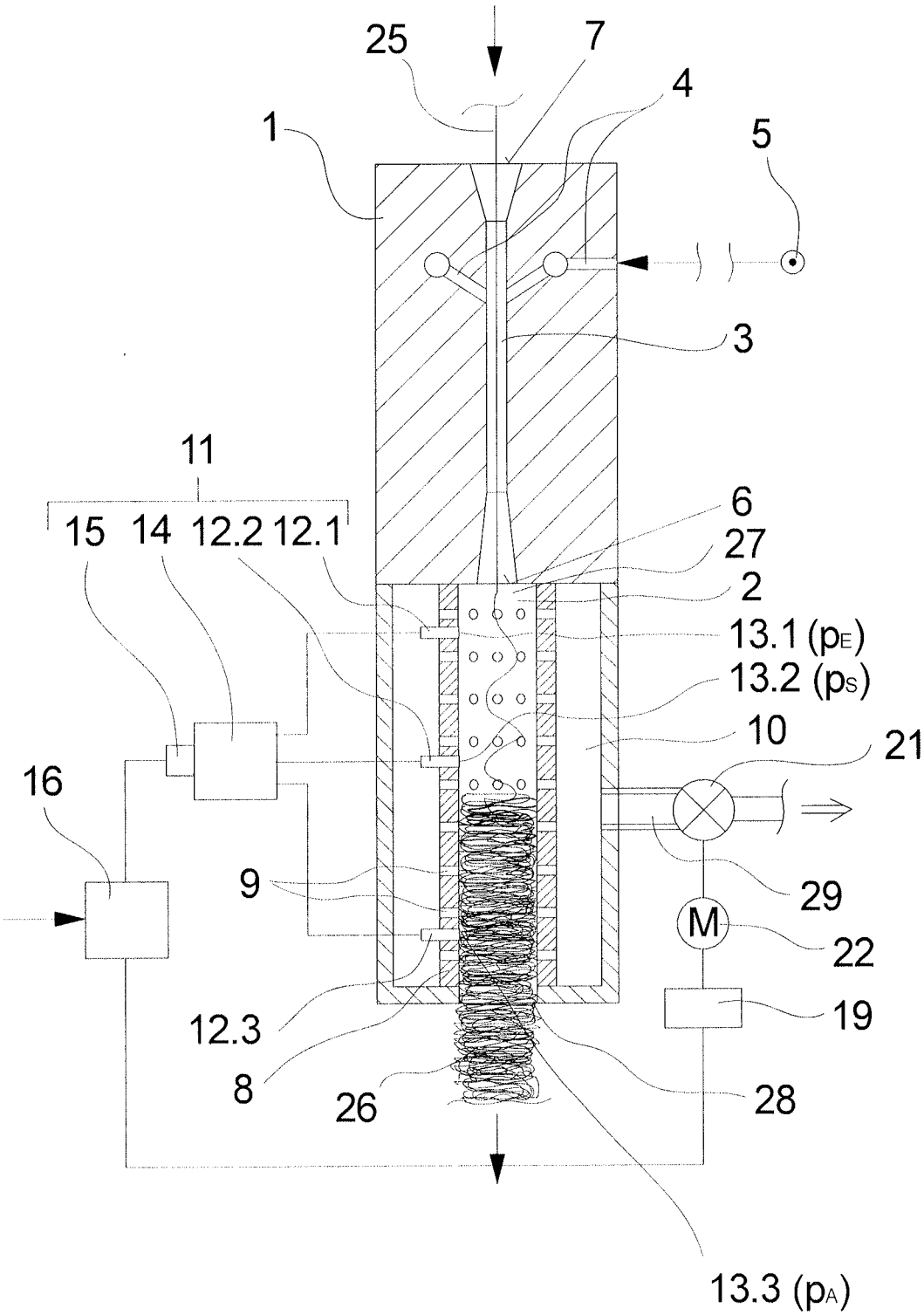
FIG. 2 is a schematic cross-sectional view of a further embodiment of the device according to the present invention.

In the embodiment shown in FIG. 1, a conveying speed of a feed roller pair is used as a control means for influencing the thread plug formation. However, it is also possible to change different adjustment parameters of different control means to influence the filling level of the compression chamber 2 when crimping a multifilament thread. For example, with negative pressure in the suction chamber, it is possible influence the frictional force between the thread plugs and the chamber wall. In this regard, FIG. 2 schematically shows a cross-sectional view of another embodiment of the device according to the present invention. The embodiment according to FIG. 2 is basically identical with the embodiment shown in FIG. 1. Therefore, only the differences are subsequently described so as to avoid repetition.

In the embodiment shown in FIG. 2, the device includes a transport nozzle 1 and a compression chamber 2. The transport nozzle 1 is designed identically to the embodiment shown in FIG. 1.

The compression chamber 2 is formed by the gas-permeable chamber walls 8 which are arranged concentrically to the thread outlet 6 of the thread channel 3. At the circumference of the compression chamber 2, a suction chamber 10 is located which is connected by means of a suction nozzle 29 with a negative pressure source, in this case a fan 21. The fan 21 is driven by means of a fan drive 22 to which a control device 19 is attached.

In this embodiment, the monitoring system 11 has a total of three pressure sensors 12.1, 12.2 and 12.3 which are located at three measurement points 13.1, 13.2 and 13.3 uniformly distributed over the length of the compression chamber 2. To measure the pressures generated by the compressed air stream inside the compression chamber 10, a first pressure sensor 12.1 is arranged in the inlet area of the compression chamber 2, a second pressure sensor 12.2 is arranged in the impact area of the compression chamber 2, and a third pressure sensor 12.3 is arranged in the outlet area of the compression chamber 2. The outlet area is located just a short distance above the compression chamber outlet 28.

All pressure sensors 12.1 to 12.3 are connected with evaluation electronics 14 which interacts with a transducer 15. The transducer 15 is connected with the controller 16 which has a direct effect on the control device 19 of the fan drive 22 of the fan 21, which is used as a control means for influencing the compression of the thread plug.

The function of the embodiment shown in FIG. 2 is identical with the embodiment according to FIG. 1. However, here the monitoring process for compressing and transporting the thread plug takes place by a total of three pressure measurements. For example, the inlet pressure $p_E$ resulting from the compressed air stream is measured by means of the pressure sensor 12.1 in the inlet area. A compression pressure $p_S$ occurring in the compression area of the compression chamber is measured by means of the pressure sensor 12.2. An outlet pressure $p_A$ prevalent at the outlet side of the compression chamber 2 is measured by means of the pressure sensor 12.3.

The measurements of the pressure sensors 12.1 to 12.3 are supplied to the evaluation electronics 14 and via a time interval given a respective average value. Subsequently, the average values of the intake pressure $p_E$ of the compression pressure $p_S$ and the outlet pressure $p_A$ are compared with each other to determine the actual filling level of the compression chamber 2. In the event that the filling level of the compression chamber is too low a control signal is supplied via the transducer 15 of the controller 16. The control signal increases the fan speed of the fan drive 22. As a result, a negative pressure prevalent in the suction chamber 10 increases, thus increasing the friction between the thread plug 26 and the chamber walls 8 of the compression chamber 2. In addition, especially in the upper area of the compression chamber 2, the removal of the compressed air stream is favorably affected, resulting in a reduced blowout effect inside the compression chamber 2. This results in an increase of the filling level of the compression chamber 2.

In an alternative case in which the filling level of the compression chamber 2 is too high, the transducer 15 supplies a signal to the controller 16, which reduces the fan speed of the fan 21. As a result, the negative pressure inside the suction chamber 10 is reduced so that less friction forces and higher blowout forces have an effect on the thread plug 26.

Supplying the middle region of the compression chamber with a measurement point allows for a finer adjustment of the plug formation inside the compression chamber 10. From the relation between the averaged measurements of the intake pressure $p_E$, the impact pressure $p_S$ and the outlet pressure $p_A$, it is possible to derive process adjustments which result in a special uniformity of the crimping in the thread. In the event that the intake pressure and the impact pressure have a basically equal pressure level, and the outlet pressure has a considerably lower pressure level, the compression chamber has a desirable optimum filling level. In the case in which the intake pressure has a considerably higher pressure level in relation to the impact pressure and the outlet pressure, the filling level of the compression chamber 10 is too high. As a result, the compression chamber is overfilled which, in an extreme case, could result in obstruction of the thread outlet 6 of the transport nozzle 1. In an operating condition in which the outlet pressure has a considerably higher pressure level in relation to the intake pressure and the impact pressure, so-called underfeeding of the compression chamber 10 takes place. The compression chamber 10 has an inadequate filling level which in particular results in uneven crimping. In an extreme case, the crimping of the thread breaks down. In this respect, the embodiment shown in FIG. 2 is especially suitable to make a very fine adjustment of the process.

Figure 3:
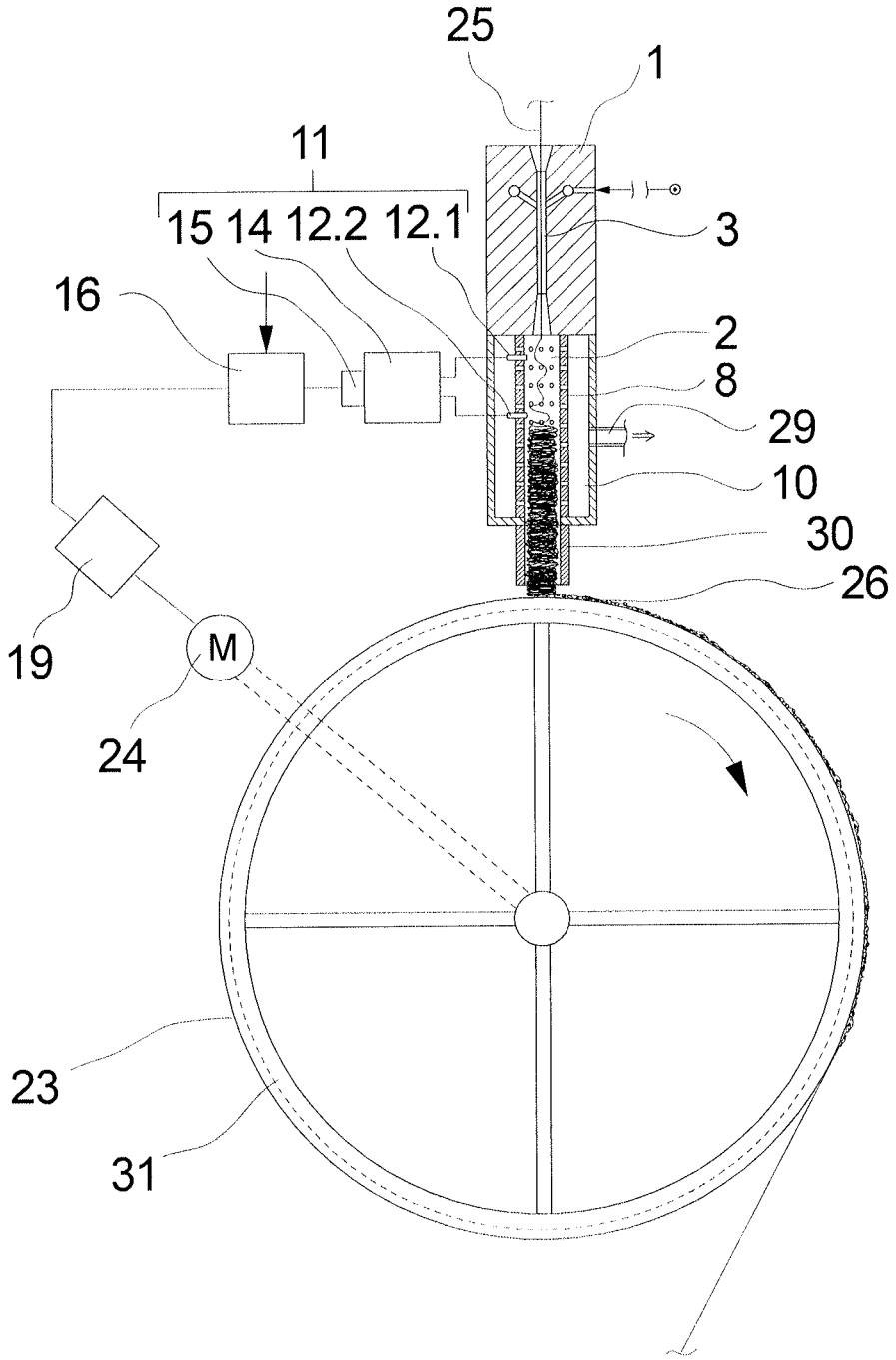
FIG. 3 is a schematic cross-sectional view of a further embodiment of the device according to the present invention.

When crimping multifilament threads, the compressed air stream is preferably formed by hot air, so that the thread is heated. As a result, it is desired that the thread plug formed form the thread is later cooled down. Usually the thread plug is cooled at the circumference of rotating cooling drums which rotate with a predetermined circumferential speed for accepting the thread plug. Advantageously, such systems can also be used for the method of the present invention in which the cooling drum is used as a control means. Therefore, FIG. 3 shows a further embodiment of the device of the present invention. In the embodiment shown in FIG. 3, the crimping device is identical with the embodiment according to FIG. 1, respectively consisting of a transport nozzle 1 and a compression chamber 2. The compression chamber 2 is attached to a monitoring system 11 which is also identical with the embodiment shown in FIG. 1. In this respect, reference is made to the above-mentioned description of FIG. 1.

Below the compression chamber 2, a cooling drum 23 has been arranged which has at its circumference a cooling groove 31. The cooling groove 31 of the cooling drum 23 is attached to the compression chamber outlet 28 to accept and transport the thread plug 26 coming out of compression chamber 2. For this purpose, the compression chamber outlet 28 is supplied with an outlet nozzle 30 which ends directly before the cooling groove 31 of the cooling drum 23. At the circumference of the cooling drum 23, the thread plug 26 is cooled with cooling air and after the cooling process it is melted to a crimped thread.

To regulate the compression and transport of the thread plug 26 inside the compression chamber 2, the monitoring system 11 is used to measure and evaluate the intake pressure $p_E$ in the inlet area of the compression chamber 2 and the impact pressure $p_S$ in the storage area of the compression chamber 2. Depending on the relation of the pressures to each other, a control device 19 of the cooling drum drive 24 is controlled via the transducer 15 and the controller 16 to drive the cooling drum 23 with a reduced or increased circumferential speed for removing the thread plug 26. As a result, the thread plug speed can be changed for regulating the thread plug formation in the compression chamber 2.

In particular, the method and the device according to the present invention are suitable to achieve with unknown crimping processes an automatic process adjustment for generating uniform product qualities when crimping a multifilament thread. In the same way, it is possible to use specific measures for making quick and immediate adjustments of process fluctuations. Moreover, the monitoring system based on pressure measurements is not susceptible to contamination so that no additional maintenance cycles are required.

The control means and adjustment parameters for regulating the thread plug mentioned in the embodiments shown in FIGS. 1 to 3 are only to be viewed as examples. Basically there are additional alternative possibilities for influencing the compression and transport of the thread plug inside the compression chamber. For example, mechanical folding elements can be used on the outlet side of the compression chamber to influence the friction and thus transport of the thread plug. For this purpose, a pivoting path or pivoting angle of the folding element can be used as adjustment parameters.

In addition, alternative braking systems, which could, for example, consist of blowing nozzles attached to the thread plug, which also influence the removal of the thread plug with additional air friction. A further possibility involves that the thread characteristics are used to influence the compression and transport of the thread plug. For example, a preparation application on a thread can be used to regulate the crimping process and plug formation in the desired manner.

Preferably, the transport nozzles and compression chambers shown in FIGS. 1 to 3 consist of two parts which can be separated for attaching the thread. In the event that the transport nozzle and the compression chamber are formed by a respective component, the thread is preferably suctioned and inserted via the compressed air stream. In addition, it is also possible to design the gas-permeable wall of the compression chambers from a plurality of ribs, which are placed next to each other to form the compression chamber. In this respect, the invention is independent and can be combined with any structural form of the transport nozzle and compression chamber.

REFERENCE LIST

1 transport nozzle
2 compression chamber
3 thread channel
4 compressed air channel
5 compressed air source
6 thread outlet
7 thread inlet
8 chamber wall
9 openings
10 suction chamber
11 monitoring system
12.1, 12.2, 12.3 pressure sensor
13.1, 13.2, 13.3 measurement point
14 evaluation electronics
15 transducer
16 controller
17 feed roller pair
18 roller drive
19 control device
20 suction device
21 fan
22 fan drive
23 cooling drum
24 cooling drum drive
25 thread
26 thread plug
27 compression chamber inlet
28 compression chamber outlet
29 suction nozzle
30 outlet channel
31 cooling groove

The invention claimed is:

1. A method for crimping a multifilament thread comprising:

a. guiding a thread through a thread channel and into a gas-permeable compression chamber by using a compressed air stream;

b. compressing the thread inside the compression chamber to a thread plug;

c. removing the thread plug through an outlet of the compression chamber and melting the thread plug to form a crimped thread; and, d. monitoring the compression and transport of the thread plug by measuring a pressure of the compressed air stream inside the compression chamber at at least two measurement points distributed over the length of the compression chamber, wherein a size of a filling level of the compression chamber is derived from a ratio of the measured pressures to each other.

2. The method of claim 1, wherein at least an intake pressure ($p_E$) of the compressed air stream is measured in an inlet area of the compression chamber and an impact pressure ($p_S$) of the compressed air stream is measured in a compression area of the compression chamber.

3. The method of claim 1, wherein the compression and/or the transport of the thread plug is controlled or regulated depending on a ratio between at least two measured pressures of the compressed air stream by changing at least one adjustment parameter.

4. The method according to claim 3, wherein the ratio is formed between an intake pressure ($p_E$) of the compressed air stream is measured in an inlet area of the compression chamber averaged by means of a measurement period and an impact pressure ($p_S$) of the compressed air stream is measured in a compression area of the compression chamber averaged by means of a measurement period, and such that the adjustment parameter is not changed when the numerical value of the ratio ranges between 0.75 and 1.15.

5. The method of claim 3, wherein the adjustment parameter is changed in such a way that a plug speed of the thread plug is reduced when the numerical value of the ratio is $<0.75$.

6. The method of claim 3, wherein the adjustment parameter is changed in such a way that a plug speed of the thread plug is increased when the numerical value of the ratio is $>1.15$.

7. A device for crimping a multifilament thread with a transport nozzle comprising:

a. a thread channel connected to a compressed air source that provides a compressed air stream;

b. a gas-permeable compression chamber having a compression chamber inlet for receiving the compressed air stream; and, c. a monitoring system that includes at least two pressure sensors for measuring a pressure of the compressed air stream inside the compression chamber such that the at least two pressure sensors are distributed at different locations in the compression chamber, wherein a size of a filling level of the compression chamber is derived from a ratio of the measured pressures to each other.

8. The device of claim 7 wherein one of the pressure sensors is located at an inlet area of the compression chamber and a second pressure sensor is located at a compression area of the compression chamber.

9. The device of claim 8, further comprising a third pressure sensor located at an outlet area of the compression chamber.

10. The device of claim 7, wherein the monitoring system comprises evaluation electronics connected with the pressure sensors.

11. The device of claim 10, wherein the evaluation electronics are connected with a transducer which generates a control signal depending on a ratio between multiple pressures of the compressed air stream.

12. The device of claim 11, wherein the monitoring system is connected with a controller to adjust an operating device to effect a change in compressing and transporting a thread plug inside the compression chamber.

13. The device of claim 12, wherein the operating device includes a driven feed roller pair located at an outlet of the compression chamber.

14. The device of claim 12, wherein the operating device includes a suction device located at an outer circumference of the compression chamber through which the compressed air is suctioned.

15. The device of claim 12, wherein the operating device includes a driven cooling drum located at an outlet of the compression chamber.

* * * * *